US011125010B2

(12) United States Patent
Kwon

(10) Patent No.: US 11,125,010 B2
(45) Date of Patent: Sep. 21, 2021

(54) END-WEIGHT DEVICE FOR A HORIZONTAL FABRIC BLIND

(71) Applicant: ZEITGEBER INC, Seoul (KR)

(72) Inventor: Youngtaek Kwon, Seoul (KR)

(73) Assignee: ZEITGEBER, INC., Seoul (KR)

( * ) Notice: Subject to any disclaimer, the term of this patent is extended or adjusted under 35 U.S.C. 154(b) by 38 days.

(21) Appl. No.: 16/345,697

(22) PCT Filed: Oct. 26, 2017

(86) PCT No.: PCT/KR2017/011914
§ 371 (c)(1),
(2) Date: Apr. 30, 2019

(87) PCT Pub. No.: WO2018/080197
PCT Pub. Date: May 3, 2018

(65) Prior Publication Data

US 2019/0383094 A1 Dec. 19, 2019

(30) Foreign Application Priority Data

Oct. 28, 2016 (KR) ..... 10-2016-0142349

(51) Int. Cl.

| | |
|---|---|
| ***E06B 9/388*** | (2006.01) |
| ***E06B 9/42*** | (2006.01) |
| ***E06B 9/56*** | (2006.01) |
| *E06B 9/24* | (2006.01) |

(52) U.S. Cl.
CPC ..... *E06B 9/388* (2013.01); *E06B 9/42* (2013.01); *E06B 9/56* (2013.01); *E06B 2009/2435* (2013.01)

(58) Field of Classification Search
CPC ... E06B 9/388; E06B 9/42; E06B 9/56; E06B 9/582; E06B 2009/2435; E06B 2009/2417; A47H 23/01
See application file for complete search history.

(56) References Cited

U.S. PATENT DOCUMENTS

| | | | | |
|---|---|---|---|---|
| 5,285,838 | A * | 2/1994 | Rapp | E06B 9/303 160/168.1 R |
| 10,174,551 | B2 * | 1/2019 | Buccola, Jr. | E06B 9/34 |
| 2014/0138037 | A1 * | 5/2014 | Colson | E06B 9/264 160/290.1 |
| 2014/0262066 | A1 * | 9/2014 | Certain | E06B 9/38 160/84.02 |
| 2015/0047792 | A1 * | 2/2015 | Lukosiunas | E06B 9/388 160/84.05 |
| 2015/0059991 | A1 * | 3/2015 | Kwak | E06B 9/322 160/113 |

* cited by examiner

*Primary Examiner* — Daniel P Cahn
*Assistant Examiner* — Poras Pradipkumar Patel
(74) *Attorney, Agent, or Firm* — Sughrue Mion, PLLC

(57) ABSTRACT

An end weight device for horizontal fabric blind includes the front and rear meshed screens fixed to a winding rod rotatably installed inside a head rail. The front and rear meshed screens are secured to each edge of a plurality of shield slats, so that sunlight can be shielded. While the plurality of shield slats is maintained in a level state, the blind allows entering the sunlight and venting air. The meshed screens are tensioned responding to pull the operating string. Since a plurality of shield slats are maintained in a level state with the front and back meshed screens due to the end weight device, the front and rear meshed screens are not separated from each other.

1 Claim, 6 Drawing Sheets

[Fig. 1]

(Prior art)

[Fig. 2]

(Prior art)

[Fig. 7]
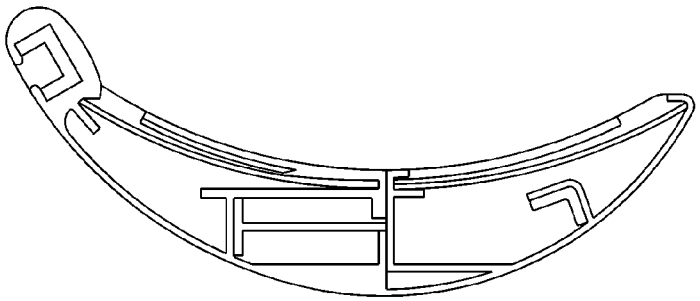
[Fig. 8]
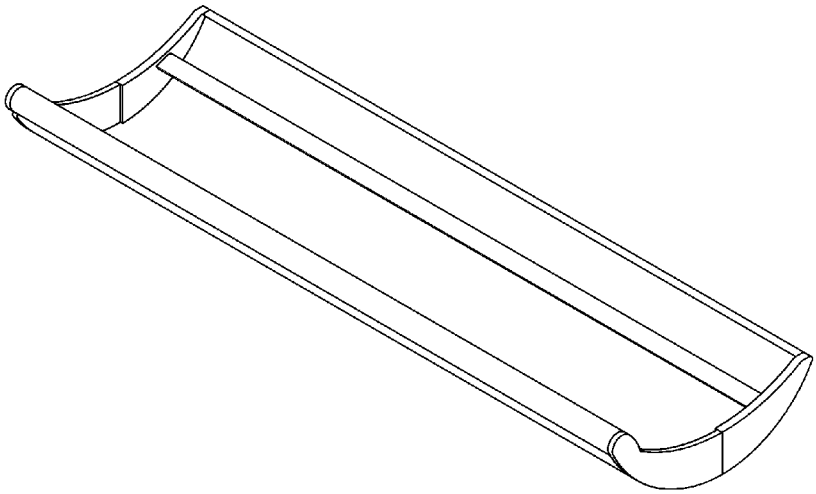

END-WEIGHT DEVICE FOR A HORIZONTAL FABRIC BLIND

BACKGROUND OF THE INVENTION

1. Field of the Invention

The present invention relates to an end-weight device for a horizontal fabric blind. More particularly, the present horizontal fabric blind has provided a plurality of light-shielding slats for blocking the sunlight, which is fixed between the front and rear meshed screens with the constant intervals. According to altering position of the light-shielding slats from horizontal to vertical by pulling the operating string, the end weight device will maintain the balance vertically against the floor for blocking the leakage of the sunlight. The end weight device of the horizontal fabric blind will maintain the constant intervals of the front and rear meshed screens to avoid separation, each other for preventing the leakage of sun-light.

2. Related Prior Art

Generally, a blind or a curtain is installed on a window or an entrance of building, not only selectively admitting or blocking the sunlight or sight, but also the purpose of preventing the chilliness or noise from the outside. In addition to those practicalities, it is used as an important element of interior decoration to enhance the interior aesthetics depending on the combination of the colors that can be combined with the interior walls or glass.

The blind that plays this role, the winding rod of the blind is rotated to forward or reverse direction depending on the pulling direction of the operating string. Then, the opening degree of the blind is adjusted by wrapping-up or loosening the screen meshes around the wind rod. The screen mesh used in this blind has a demerit that cannot be controlled the amount of emitted sun-light or air-ventilation, at all, when the screen is fully un-folded across in front of the window or doorway.

Considering this point of view, a Korean patent application No. 10-2010-0103568 (Korean unexamined patent publication No. 10-2011-0004340) has been filed as a blind capable of opening and closing in the vertical direction.

Considering a conventional blind as shown in the FIG. 1 and FIG. 2, which can be operated of the opening and closing in the vertical direction, it generally has a purpose to easily control the emitting sun-light, air-ventilation or sight-through. It is consisted of a front meshed screen (13), a rear meshed screen (14) and a light-shielding slat (15) interposed between the front meshed screen (13) and the rear meshed screen (14) for blocking light. The blind screen (10) is integrally woven with the front meshed screen (13) and the rear meshed screen (14) being fixed with the light-shielding slat (15). The light-shielding slat (15) is integrally woven to a front connecting knot (17) on the front meshed screen (13) and a rear connecting knot (18) on the rear meshed screen (14) for tilting the blind screen.

Accordingly, the blind screen (10) being integrally woven with the front meshed screen (13) and the rear meshed screen (14) being connected with the light-shielding slat (15), the winding rod (not shown) being rotatably provided inside of the frame (20) is fixed on one end, and other end is fixed to the end weight device (19) for maintaining tension state of the blind screen (10). As the winding rod is rotated, the blind screen (10) is rolled or loosened while the blind screen (10) is maintaining the state of tension.

That is, when the operating string is pulled to maintain the level state as shown in FIG. 1, the light-shielding slat (15) being located between the front meshed screen (13) and the rear meshed screen (14) will be in the level position, so that the blind screen (10) will allow the emitting of the sun-light and air ventilation through the front meshed screen (13) and the rear meshed screen (14).

In this situation, as the operating string is fully pulled, as shown in FIG. 2, the front and rear meshed screen (13 and 14) are brought to near close each other, and the light shielding slats (15) are vertically overlapped each other, so that the inside and outside of the meshed screens are kept to be shielded.

However, as described above the conventional blind being capable of opening and closing in the vertical direction, the front and rear meshed screen (13 and 14) and the shielding slats (15) are not fully contacted to close each other by further pulling the operating string in order to block the sunlight inflow. However, as shown in FIG. 2, the end weight device (19) is remained a tilted state not a perpendicular to the floor surface. So that, the front and rear meshed screen (13 and 14) and the shielding slats (15) will not be fully closed. As a result, it has a problem that a light leakage phenomenon occurs, in which the sunlight penetrates through the shielding slats (15).

PRIOR ART

<Filed Patent Application No.>

A Korean patent application No. 10-2010-0103568 has filed on the Oct. 22, 2010.

A patent title: The blind capable opening and closing in the vertical direction.

SUMMARY OF THE INVENTION

Accordingly, the present invention is invented to solve the aforementioned problems of the prior art as described above; an objective of the present invention is to provide an end weight device of the blind to maintain the vertical balance against the floor by the weight difference and provide a proper tension on the both meshed screens for preventing the separation on the shielding slat, while a plurality of the shading slats are altering from a horizontal state to a vertical state by pulling of the operating string. If the end weight device fails to maintain the proper tension on both meshed screens, the shading slats and the front and rear mesh screens are occurred a separation to cause the leaking of the sunlight through the meshed screens.

The other objectives of the present invention will be apparent as precede the invention.

In order to accomplish the above objective, the end weight device of the present invention provides that one end and the other end of the shielding slats are integrally attached by fixing means, such as a double-sided tape to the front and rear meshed screen, respectively. Thus, a plurality of the shielding slats is integrally fixed or woven to the front and rear meshed screen with constant intervals for blocking the sunlight. The end weight device forms a bar-shaped fixing plate. Both ends of the bar-shaped fixing plate have a hook-style fastening mean for fixedly connecting to the ends of the front and rear meshed screens. The bar-shaped fixing plate has downwardly curved shape at the center. The end weight device has provided an eccentric means on one side of the hook-style fastening mean for automatically maintaining the level state of the shielding slats with respect to the front and rear meshed screens. The center of weight will be eccentric by extending outwardly at one end of the hook-style fastening mean, when the shielding slat alters to vertical state for responding the operating string. The end weight device consists of a cover for preventing fall-off the fastening mean.

The eccentric means at one side of the end weight device provides a longitudinal cavity for inserting an extra weight for increasing the weight.

As described above, the end weight device of a horizontal fabric blind according to the present invention, a plurality of the shielding slats is moved from horizontal to vertical for shading by pulling the operating string, then, the end weight device will automatically be maintained the vertical position against the floor due to the weight eccentricity. There is no separation between the shielding slats and the front and rear meshed screens. So that, there is no sunlight leakage phenomenon occurred between the shielding slats and the both meshed screens.

BRIEF DESCRIPTION OF THE DRAWINGS

FIG. 7 is a detail sectional view illustrating the end weight device (130) of the present invention.

FIG. 8 is a perspective view showing the end weight device (130) of the present invention.

DETAILED DESCRIPTION OF THE PREFERRED EMBODIMENTS

Figure 1:
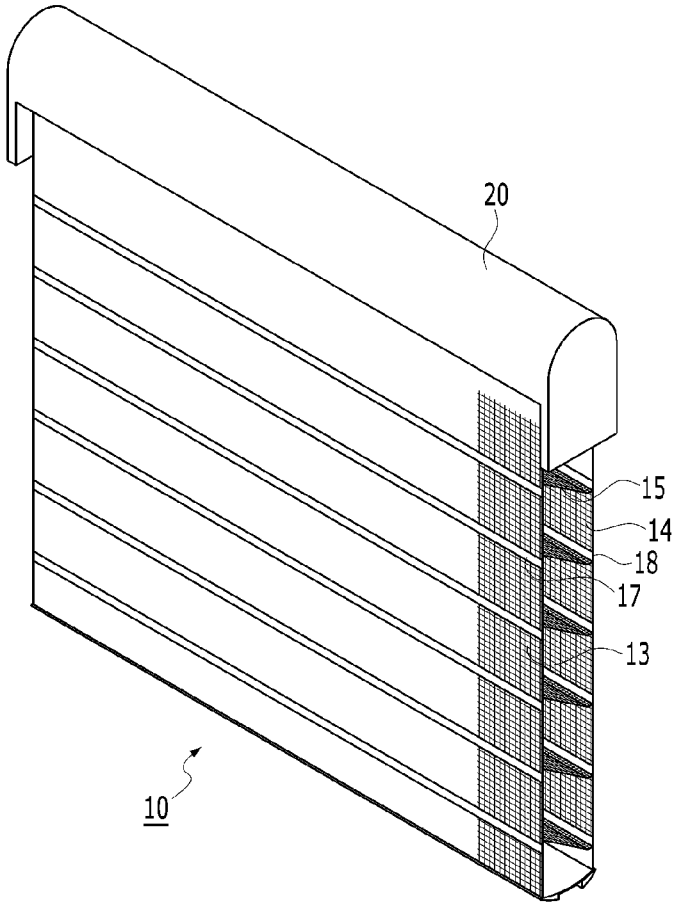
FIG. 1 shows a conventional blind, which is capable of opening and closing in the vertical direction.
Figure 2:
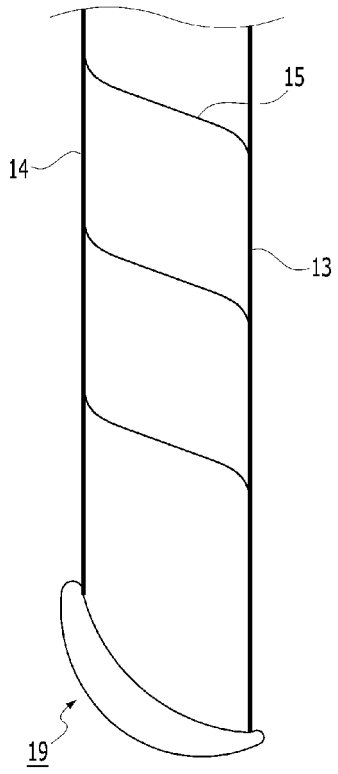
FIG. 2 shows a lateral view of conventional blind, which is fully-deployed for the opening-closing operation.

Hereinafter, the end weight device for the horizontal fabric blind of the preferred embodiment of the present invention will be described in great detail with reference to the accompanying drawings.

However, the purpose of accompanied drawings is easily described the present invention. The scope of the present invention is not limited to the scope of the accompanied drawings. It will be appreciated those who skilled in the art.

First of all, it should be noted that the same components or parts in the drawings have the same reference numerals as much as possible. In the following description of the present invention, a detailed description of known functions and configurations incorporated herein will be omitted so as not to obscure the gist of the invention.

As shown in the drawing, the end weight device (100) for a horizontal fabric blind of the present invention is provided that: a winding rod (not shown) is rotatably installed inside of the head rail (50) of the horizontal fabric blind (30). A plurality of shield slats (80) is integrally and fixedly attached to the front and rear meshed screens (60, 70) with constant intervals. Both ends of the shield slats and the meshed screens (60, 70) are integrally woven each other for blocking the sunlight. A plurality of shield slats (80) and both of the meshed screens (60, 70) allows venting the air and admitting the sunlight at the level state of the shield slats (80) by operating string. Due to shifting the weight, a plurality of the shield slats (80) alters to the vertical state respect to the front and rear meshed screens (60, 70). The front and rear meshed screens (60, 70) are not separated by automatically maintaining the level state of the shield slats (80), each other. Thereby, it will prevent the leakage of sunlight through the plurality of shield slats (80). Also, it will prevent a swinging while the winding rod is winding by shifting the weight to one-side.

In other words, the end weigh device (100) for a horizontal fabric blind according to the present invention has a structure as shown in FIG. 3 to FIG. 6. It is consist of the front and rear meshed screens (60, 70), a plurality of the shield slats (80) is integrally woven to each end-side of the front and rear meshed screens (60, 70) with constant intervals for blocking the sunlight. A shielding portion (40) of the horizontal fabric blind (30) is consisted of the plurality of the shield slats (80) being integrally attached with the front and rear meshed screens (60, 70). A fixing plate (110) forming a bar-shape is integrally connected to the front and rear meshed screens (60, 70) by the fixing means, such as both-side tapes. First and second fastening sectors (131, 132) are formed at each end-side of the fixing plate (110), so that each end of the fixing plate (110) can be attached to the front and back meshed screens (60, 70), respectively. The center portion of the fixing plate (110) has formed a downward curvature portion (133). An end of the first fastening sector (131) is outwardly extended. An end weight device (130) has provided an eccentric weight portion (134) so that the end weight device (130) will respond to the pulling of the operating string (90) to rotate the shield slats (80) for automatically maintaining the level state, with respect to the front and rear meshed screens (60, 70) by the eccentric weight. Both edge-side of the end weight device (130) forms clamping portion to fixedly insert the front and rear meshed screens (60, 70), respectively. And, a cover member (150) is provided to prevent the detaching the fixing plate (110).

Herein, the eccentric weight portion (134) of the end weight device (130) has formed a longitudinal cavity (134*a*) for inserting a weight member (170), so that the end weight device (130) can increase the eccentric weight along the longitudinal direction, Additionally, the end weight device (130) is preferably made of aluminum or resin (resin) to form an eccentric weight.

On the other hand, the end weight device (130) of the horizontal fabric blinds according to the present invention, the end weight device (130) would be formed as a single body as shown in FIG. 3 to FIG. 6, but it is not limited thereto. As shown in FIG. 7, the left and right edges of the end weight device (130) could be attached and detached by adopting a sliding method to the front and rear meshed screens (60, 70), respectively. A cover member as shown in FIG. 8, can be inserted to be fixed at both edges of the end weight device (130).

Figure 3:
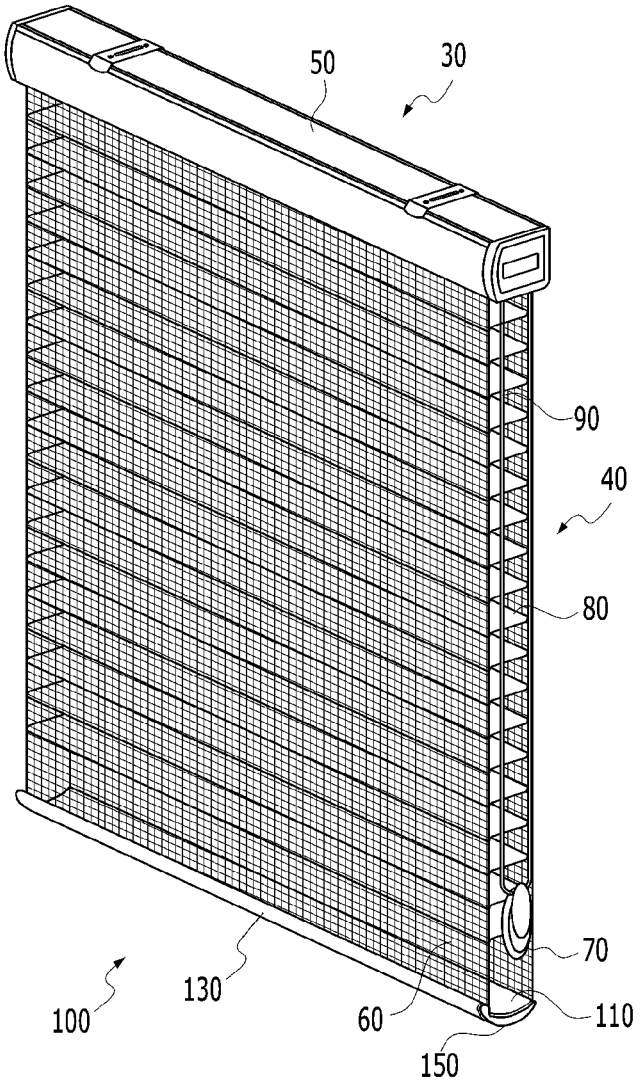
FIG. 3 shows a horizontal fabric blind of the present invention being installed an end-weight device and fully-deployed with the screen.
Figure 4:
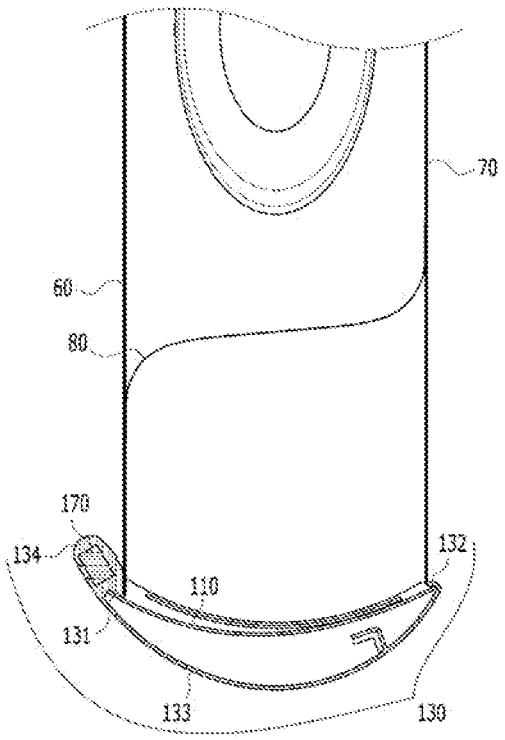
FIG. 4 shows a lateral view of the lower portion of the present invention being fully-deployed screen with the end-weight device.
Figure 5:
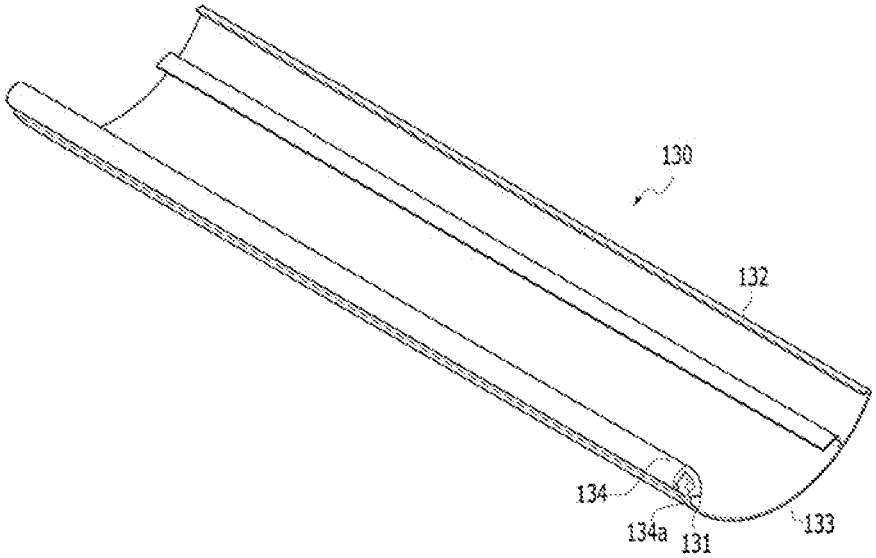
FIG. 5 is a perspective view of the end-weight device according to the present invention.

The end weight device of the horizontal fabric blind according to the present invention: when a user pulls the operating string, the shielding portion (40) of the horizontal fabric blind (30) will fully deployed as shown in FIG. 3, while the winding rod installed inside of head rail is actuating the shielding portion (40) of the horizontal fabric blind.

At this moment, the plurality of light-shield slats (80) are maintained in a horizontal state as shown in FIG. 3, it will allow to admit the sunlight and air is ventilating.

Figure 6:
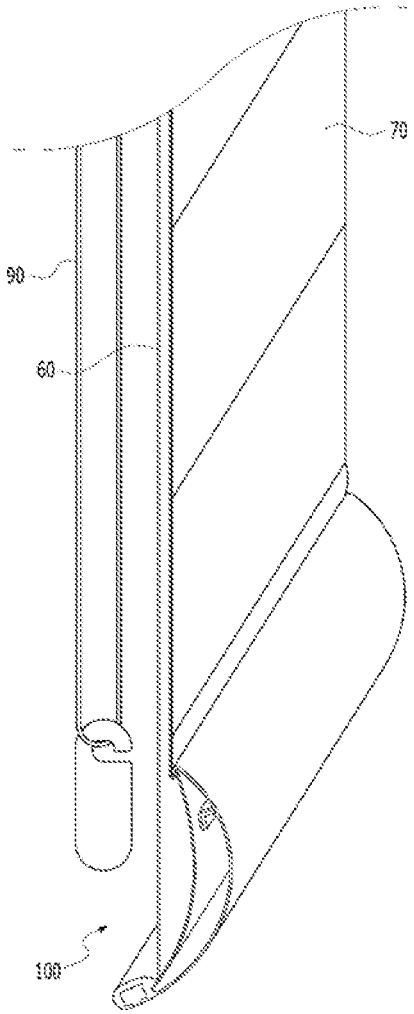
FIG. 6 shows the fully-opened end-weight device with the fully-deployed screen of the present invention for shading the sun-light.

Further, a user pulls the operating string, the end weight device (130) of the horizontal fabric blind according to the present invention is shifted by the eccentric weight portion (134) to face the wall as shown in FIG. 6.

Thus, the end weight device (130) automatically maintains a straight line with respect to the front and rear meshed screens (60, 70).

Because the end weight device (130) is closely aligned to the front and rear meshed screens (60, 70), the front and rear meshed screens (60, 70) would be flat without a space.

Accordingly, the plurality of shield slats (80) attached between the front and rear meshed screens (60, 70) with predetermined intervals will be overlapped each other and maintained the vertical state, so that the sunlight is blocked by the light-shielding slats (80).

The foregoing description is merely illustrative of the technical idea of the present invention. Further, the various changes and modifications may be made easily by those skilled in the art without departing from the essential characteristics of the present invention. Therefore, the embodiments disclosed in the present invention are intended to illustrate rather than limit the scope of the present invention. The scope of the technical idea of the present invention is not limited by these embodiments. It is intended that the present invention cover the modifications and variations of this invention provided they come within the scope of the appended claims and their equivalents.

What is claimed is:

1. A horizontal fabric blind comprising:

a front meshed screen (60), a rear meshed screen (70), and a plurality of shield slats (80) for blocking a sun light, wherein the plurality of shield slats (80) are arranged with constant intervals between the front meshed screen (60) and the rear meshed screen (70), each slat of the plurality of shield slats (80) extends in a longitudinal direction and is integrally woven to the front meshed screen (60) and the rear meshed screen (70), respectively, and a state of the plurality of shield slats (8) changes between a horizontal state and a vertical state by a pulling of an operating string (90);

a fixing plate (110) including a first end attached to an end of the front meshed screen (60) and a second end attached to an end of the rear meshed screen (70);

an end weight device (130) having a first fastening sector (131), a second fastening sector (132), a downward curvature portion (133) formed in a center of the end weight device (130), and an eccentric weight portion (134) formed at an edge of the first fastening sector (131), wherein the first fastening sector (131) is coupled to the first end of the fixing plate (110) and the second fastening sector (132) is coupled to the second end of the fixing plate (110); and a cover member (150) being used to prevent detaching the fixing plate (110), wherein a first edge of the end weight device (130) is integrally fixed to the end of the front meshed screen (60) and a second edge of the end weight device (130) is integrally fixed to the end of the rear meshed screen (70), wherein the eccentric weight portion (134) of the end weight device (130) comprises a longitudinal cavity (134*a*) extending in the longitudinal direction, wherein a weight member (170) is inserted into the longitudinal cavity (134*a*) of the eccentric weight portion (134) to increase weight of the eccentric weight portion (134), wherein, in the horizontal state of the plurality of shield slats (80), the eccentric weight portion (134) formed at the edge of the first fastening sector (131) is higher than the edge of the second fastening sector (132) and protrudes upwardly in front of the front meshed screen (60), and wherein the end weight device (130) is automatically maintained to be substantially parallel to the front meshed screen (60) and the rear meshed screen (70) by the weight of the eccentric weight portion (134) formed at the edge of the first fastening sector (131), and the eccentric weight portion (134) formed at the edge of the first fastening sector (131) protrudes downwardly in front of the first meshed screen (60) when the state of the plurality of shield slats (80) becomes the vertical state by responding to the pulling of the operating string (90).

* * * * *